US011433506B2

(12) United States Patent
Akashi et al.

(10) Patent No.: US 11,433,506 B2
(45) Date of Patent: Sep. 6, 2022

(54) WHEEL BRUSH AND GRINDING ELEMENT BUNDLE HOLDER

(71) Applicants: TAIMEI CHEMICALS CO., LTD., Nagano (JP); XEBEC TECHNOLOGY CO., LTD., Tokyo (JP)

(72) Inventors: Mitsuhisa Akashi, Nagano (JP); Koji Sato, Tokyo (JP)

(73) Assignees: TAIMEI CHEMICALS CO., LTD., Nagano (JP); XEBEC TECHNOLOGY CO., LTD., Tokyo (JP)

( * ) Notice: Subject to any disclaimer, the term of this patent is extended or adjusted under 35 U.S.C. 154(b) by 728 days.

(21) Appl. No.: 16/317,539

(22) PCT Filed: Jul. 15, 2016

(86) PCT No.: PCT/JP2016/071085

§ 371 (c)(1),
(2) Date: Jan. 12, 2019

(87) PCT Pub. No.: WO2018/011997

PCT Pub. Date: Jan. 18, 2018

(65) Prior Publication Data

US 2019/0291244 A1 Sep. 26, 2019

(51) Int. Cl.
*B24D 13/10* (2006.01)
*B24D 13/04* (2006.01)
(Continued)

(52) U.S. Cl.
CPC ..... *B24D 13/145* (2013.01); *B24D 9/003* (2013.01); *B24D 9/04* (2013.01); *B24D 11/00* (2013.01);
(Continued)

(58) Field of Classification Search
CPC . B24D 9/003; B24D 9/04; B24D 9/06; B24D 9/08; B24D 9/085; B24D 13/04;
(Continued)

(56) References Cited

U.S. PATENT DOCUMENTS 2,439,962 A * 4/1948 Bonkowski ..... B24D 9/003 451/467
3,872,630 A * 3/1975 Ali ..... B24D 13/06 451/468
(Continued)

FOREIGN PATENT DOCUMENTS

JP S57-501612 A 9/1982
JP S63-21920 A 1/1988
(Continued)

OTHER PUBLICATIONS

WIPO, International Search Report for International Application No. PCT/JP2016/071085, dated Sep. 27, 2016.
(Continued)

*Primary Examiner* — Eileen P Morgan

(57) ABSTRACT

A wheel brush (1) includes a grinding element bundle holder (3) having an annular grinding element bundle-holding surface (12) that faces the outer circumferential side and a plurality of grinding element bundles (4) that are formed by gathering a plurality of wire-shaped grinding elements (5). The grinding element bundle-holding surface (12) has a plurality of holding holes (16) arrayed in a circumferential direction (R), the grinding element bundles (4) protrude to the outer circumferential side from the grinding element bundle-holding surface (12) while one end portions are inserted into the holding holes (16). First protrusions (18) protruding to the outer circumferential direction are provided on first opening edge portions (17*a*) adjacent to the holding holes 16 at a first direction (L1) side in the rotational center line direction orthogonal to the circumferential direc-
(Continued)

tion R (R) in opening edges of the holding holes (16) in the grinding element bundle-holding surface (12). The first protrusions (18) are continuous in the circumferential direction R (R) to configure an annular first flange portion (19).

5 Claims, 9 Drawing Sheets

(51) Int. Cl.

| | |
|---|---|
| ***B24D 9/04*** | (2006.01) |
| ***B24D 13/14*** | (2006.01) |
| ***B24D 18/00*** | (2006.01) |
| ***B24D 11/00*** | (2006.01) |
| ***B24D 13/20*** | (2006.01) |
| ***B24D 9/00*** | (2006.01) |

(52) U.S. Cl.
CPC ..... *B24D 13/04* (2013.01); *B24D 13/10* (2013.01); *B24D 13/20* (2013.01); *B24D 18/0072* (2013.01)

(58) Field of Classification Search
CPC ..... B24D 13/045; B24D 13/06; B24D 13/10; B24D 13/145; B24D 13/20; B24D 18/0072
USPC ..... 451/496, 498, 502, 508, 532
See application file for complete search history.

(56) References Cited

U.S. PATENT DOCUMENTS

| | | | | |
|---|---|---|---|---|
| 4,004,316 | A * | 1/1977 | Ali | B24D 13/06 15/230.16 |
| 4,324,017 | A | 4/1982 | Viehe | |
| 6,592,442 | B2 * | 7/2003 | Hoffheimer | B24D 13/045 248/231.81 |
| 6,840,848 | B1 * | 1/2005 | Dyar | B24D 13/20 451/344 |
| 6,949,019 | B2 * | 9/2005 | Wentworth | B24D 5/06 451/466 |
| 7,207,876 | B2 * | 4/2007 | Hoffheimer | B24D 13/06 451/466 |
| 7,578,730 | B2 * | 8/2009 | Chen | B24D 13/10 403/341 |
| 9,554,642 | B2 * | 1/2017 | Montabaur | A46B 13/001 |
| 9,623,541 | B2 * | 4/2017 | Srihari | B24D 11/001 |
| 10,399,207 | B2 * | 9/2019 | Akashi | B24D 9/003 |
| 2005/0153642 | A1 | 7/2005 | Matsushita et al. | |
| 2010/0154153 | A1 * | 6/2010 | Hooper | A46B 3/10 15/104.05 |
| 2011/0021117 | A1 * | 1/2011 | Bullock | B24D 13/06 451/177 |
| 2018/0304444 | A1 * | 10/2018 | Matsushita | B24D 13/145 |
| 2019/0143487 | A1 * | 5/2019 | Clifford | A46B 13/008 451/527 |
| 2019/0291244 | A1 * | 9/2019 | Akashi | B24D 18/0072 |
| 2020/0198097 | A1 * | 6/2020 | Keiser | B24D 13/10 |

FOREIGN PATENT DOCUMENTS

| | | | |
|---|---|---|---|
| JP | H03-29260 | U | 3/1991 |
| JP | H05-162085 | A | 6/1993 |
| JP | 2002-219656 | A | 8/2002 |
| JP | 2005-199371 | A | 7/2005 |
| JP | 2014-172126 | A | 9/2014 |
| WO | 2004/009293 | A1 | 1/2004 |
| WO | 2016/067345 | A1 | 5/2016 |

OTHER PUBLICATIONS

WIPO, Written Opinion for International Application No. PCT/JP2016/071085, dated Sep. 27, 2016.
Japan Patent Office, Office Action for Japanese Patent Application No. 2018-527374, dated Feb. 18, 2020.

* cited by examiner

WHEEL BRUSH AND GRINDING ELEMENT BUNDLE HOLDER

FIELD

The present invention relates to a wheel brush that polishes a workpiece with a grinding element bundle and a grinding element bundle holder that holds the grinding element bundle.

BACKGROUND

Patent Literature 1 discloses a wheel brush that polishes and grinds a workpiece with a grinding element bundle formed by gathering a plurality of wire-shaped grinding elements. The wheel brush disclosed in Patent Literature 1 includes a plurality of grinding element bundles that are radially arrayed about a rotational center line of the wheel brush and a cylindrical grinding element bundle holder that holds end portions of the grinding element bundles at the inner circumferential side. The grinding element bundle holder has an annular grinding element bundle-holding surface that faces the outer circumferential side while surrounding the rotational center line and the grinding element bundle-holding surface has a plurality of holding holes arrayed in the circumferential direction. The end portions of the grinding element bundles at the inner circumferential side are inserted into the holding holes and protrude to the outer circumferential side from the grinding element bundle-holding surface.

In work on the workpiece using the wheel brush disclosed in Patent Literature 1, the grinding element bundle holder is coupled to a head of a machine tool and the wheel brush is rotated about the rotational center line. End portions of the grinding element bundles at the outer circumferential side are brought into contact with the workpiece to polish and grind the workpiece.

Patent Literature 2 discloses a wire-shaped grinding element formed by impregnating and solidifying an assembly of inorganic filaments with resin. The wire-shaped grinding element disclosed in Patent Literature 2 has a flattened-shaped grinding element cross section orthogonal to the element axial direction.

CITATION LIST

Patent Literature

Patent Literature 1: Japanese Patent Application Laid-open No. 2005-199371

Patent Literature 2: Japanese Patent Application Laid-open No. 2014-172126

SUMMARY

Technical Problem

When the end portions of the grinding element bundles at the outer circumferential side are brought into contact with the workpiece in the state in which the wheel brush is rotated, expansion of the grinding element bundles in the rotational center line direction tends to cause breaking of the wire-shaped grinding elements configuring the grinding element bundles and it is a problem.

In view of the foregoing, an object of the present invention is to provide a wheel brush that can suppress breaking of wire-shaped grinding elements of grinding element bundles protruding to the outer circumferential side from a grinding element bundle holder in a work operation of grinding and polishing a workpiece.

Solution to Problem

In order to achieve the above-described object, a wheel brush according to the present invention includes a plurality of grinding element bundles that are radially arrayed about a rotational center line, and a grinding element bundle holder that holds end portions of the grinding element bundles at an inner circumferential side, wherein the grinding element bundle holder has an annular grinding element bundle-holding surface that faces an outer circumferential side while surrounding the rotational center line, the grinding element bundle-holding surface has a plurality of holding holes arrayed in a circumferential direction, the grinding element bundles include a plurality of wire-shaped grinding elements gathered in parallel and protrude to the outer circumferential side from the grinding element bundle-holding surface while end portions of the wire-shaped grinding elements at the inner circumferential side are inserted into the holding holes, and first protrusions protruding to the outer circumferential side are provided on first opening edge portions adjacent to the holding holes at one side in the rotational center line direction in opening edges of the holding holes in the grinding element bundle-holding surface.

According to the invention, the first protrusions are provided on the first opening edge portions adjacent to the holding holes in the rotational center line direction in the grinding element holding surface of the grinding element bundle holder. Accordingly, in a work operation on a workpiece while the wheel brush is rotated about the rotational center line, when the grinding element bundles are about to expand to one side in the rotational center line direction, the grinding element bundles that start to bend abut against the first protrusions. The abutment suppresses the expansion of the grinding element bundles to the one side, so that excessive curve of the wire-shaped grinding elements configuring the grinding element bundles in the rotational center line direction and breaking thereof can be suppressed in the work operation. The expansion of the grinding element bundles in the rotational center line direction is suppressed, whereby lowering of grinding force of grinding and polishing the surface of the workpiece with the wheel brush can be suppressed in the work operation.

In the present invention, it is preferable that second protrusions protruding to the outer circumferential side be provided on second opening edge portions adjacent to the holding holes at the other side in the rotational center line direction in the opening edges of the holding holes in the grinding element bundle-holding surface. With this configuration, in the work operation on the workpiece while the wheel brush is rotated about the rotational center line, when the grinding element bundles are about to expand to the other side in the rotational center line direction, the grinding element bundles that start to bend abut against the second protrusions. The abutment suppresses the expansion of the grinding element bundles to the other side, so that excessive curve of the wire-shaped grinding elements configuring the grinding element bundles in the rotational center line direction and breaking thereof can be suppressed in the work operation. The expansion of the grinding element bundles in the rotational center line direction is suppressed, whereby lowering of the grinding force of grinding and polishing the surface of the workpiece with the wheel brush can be suppressed in the work operation.

In the present invention, the respective first protrusions can be continuous to the first protrusions adjacent in the circumferential direction to configure an annular first flange portion and the respective second protrusions can be continuous to the second protrusions adjacent in the circumferential direction to configure an annular second flange portion. With this configuration, even when the grinding element bundles are made into a state of being curved in the circumferential direction in the work operation, expansion of the grinding element bundles to one side and the other side in the rotational center line direction (one side and the other side in the rotational center line direction) can be suppressed. The breaking of the wire-shaped grinding elements configuring the grinding element bundles in the work operation can therefore be suppressed. The expansion of the grinding element bundles in the rotational center line direction is suppressed, whereby lowering of the grinding force of grinding and polishing the surface of the workpiece with the wheel brush can be suppressed in the work operation.

In this case, the grinding element bundle holder can include a first holder member having the holding holes and the first flange portion and a second holder member having the second flange portion and laminated at an opposite side to the first flange portion of the first holder, and the holding holes can be opened in a lamination surface of the first holder member on which the second holder member is laminated. With this configuration, when the grinding element bundles are inserted into the holding holes to be held by the grinding element bundle holder, the grinding element bundles can be inserted into the holding holes through openings of the holding holes that are exposed to the lamination surface of the first holder member and openings of the holding holes that are exposed to the outer circumferential surface (grinding element bundle-holding surface) of the first holder member. Accordingly, the first holder member can easily hold the grinding element bundles. When the grinding element bundles are caused to abut against the first flange portion when being inserted into the holding holes, the first flange portion functions as a guiding portion guiding the grinding element bundles into the holding holes. Accordingly, the grinding element bundles are easily inserted into the holding holes.

In the present invention, it is preferable that circumferential direction opening edge portions located adjacent to the holding holes in the circumferential direction in the opening edges of the holding holes in the grinding element bundle-holding surface be inclined to the inner circumferential side toward the holding holes. With this configuration, the grinding element bundles held in the holding holes are easy to be curved in the circumferential direction. The grinding element bundles are thereby easy to be deflected in the work operation in which the wheel brush is rotated about the rotational center line to bring the end portions of the grinding element bundles at the outer circumferential side into contact with the workpiece. The deflection of the grinding element bundles can release load on the grinding element bundles from the workpiece side. Accordingly, the breaking of the wire-shaped grinding elements configuring the grinding element bundles can further be suppressed. When the circumferential direction opening edge portions in the grinding element bundle-holding surface are inclined to the inner circumferential side toward the holding holes, the circumferential direction opening edge portions serve as guiding surfaces guiding the grinding element bundles to the holding holes in the insertion of the grinding element bundles into the holding holes and the insertion is therefore easily performed.

In the present invention, preferably, openings of the holding holes in the grinding element bundle-holding surface have such flattened shapes that width dimensions in the circumferential direction are smaller than height dimensions in the rotational center line direction, and cross sections of the grinding element bundles cut along the grinding element bundle-holding surface have flattened shapes that are fitted with the openings of the holding holes in the grinding element bundle-holding surface. With this configuration, the grinding element bundles are easy to be deflected in the short-side direction (circumferential direction) of the grinding element bundle cross sections as compared with the case in which the grinding element bundle cross sections do not have the flattened shapes. Accordingly, the load on the grinding element bundles from the workpiece side can be released by the deflection of the grinding element bundles in the work operation in which the wheel brush is rotated about the rotational center line to bring the end portions of the grinding element bundles at the outer circumferential side into contact with the workpiece. The breaking of the grinding elements configuring the grinding element bundles can therefore further be suppressed. The flattened shape is such shape that a distance from the center of the cross section to the outer periphery is not constant and the length in the lengthwise direction and the length in the short-side direction are different from each other.

In the present invention, it is preferable that equal to or higher than 10% of the wire-shaped grinding elements gathered as the grinding element bundles have the grinding element cross sections the short-side directions of which are directed to the circumferential direction. When some of the wire-shaped grinding elements are oriented such that the short-side directions of the grinding element cross sections thereof are directed to the the circumferential direction in the formation of the grinding element bundles by gathering the wire-shaped grinding elements, the grinding element bundles are easy to be deflected in the circumferential direction as compared with the case in which the grinding element bundles are formed by gathering the wire-shaped grinding elements without orienting them. Accordingly, the load on the grinding element bundles from the workpiece side can be released by the deflection of the grinding element bundles in the work operation in which the wheel brush is rotated about the rotational center line to bring the end portions of the grinding element bundles at the outer circumferential side into contact with the workpiece. The breaking of the wire-shaped grinding elements configuring the grinding element bundles can therefore be suppressed. The flattened shape is such shape that a distance from the center of the grinding element cross section to the outer periphery is not constant and the length in the lengthwise direction and the length in the short-side direction are different from each other. "The short-side directions of the grinding element cross sections of the wire-shaped grinding elements are directed to the circumferential direction" indicates that an angle difference between the circumferential direction and the short-side directions of the grinding element cross sections is smaller than 45°.

In the present invention, it is preferable that an adhesive interposed between the grinding element bundle holder and the grinding element bundles in the holding holes and fixing the grinding element bundles to the grinding element bundle holder be provided, the holding holes have first inner wall surfaces and second inner wall surfaces opposing each other in the circumferential direction and third inner wall surfaces connecting ends of the first inner wall surfaces at the inner circumferential side and ends of the second inner wall surfaces at the inner circumferential side, and intervals between the first inner wall surfaces and the second inner wall surfaces be enlarged toward the third inner wall surfaces from the grinding element bundle-holding surface. With this configuration, spaces that are filled with the adhesive interposed between the grinding element bundles and the grinding element bundle holder are formed at the deep side (inner circumferential side) of the holding holes. Accordingly, an anchor effect of the adhesive filling the spaces can prevent or suppress disengagement of the grinding element bundles inserted into the holding holes.

In the present invention, it is preferable that an adhesive interposed between the grinding element bundle holder and the grinding element bundles in the holding holes and fixing the grinding element bundles to the grinding element bundle holder be provided, the holding holes have first inner wall surfaces and second inner wall surfaces opposing each other in the circumferential direction and third inner wall surfaces connecting ends of the first inner wall surfaces at the inner circumferential side and ends of the second inner wall surfaces at the inner circumferential side, and at least ones of the first inner wall surfaces and the second inner wall surfaces have recesses recessed in a direction away from the other. With this configuration, the recesses provided in at least ones of the first inner wall surfaces and the second inner wall surfaces of the holding holes can be filled with the adhesive interposed between the grinding element bundles and the grinding element bundle holder. Accordingly, the anchor effect of the adhesive filling the recesses can prevent or suppress disengagement of the grinding element bundles inserted into the holding holes.

In the present invention, it is preferable that an adhesive interposed between the grinding element bundle holder and the grinding element bundles in the holding holes and fixing the grinding element bundles to the grinding element bundle holder be provided, the holding holes have first inner wall surfaces and second inner wall surfaces opposing each other in the circumferential direction and third inner wall surfaces connecting ends of the first inner wall surfaces at the inner circumferential side and ends of the second inner wall surfaces at the inner circumferential side, and the third inner wall surfaces be folded or bent. With this configuration, adhesion areas between the third inner wall surfaces and the grinding element bundles can be increased. Accordingly, disengagement of the grinding element bundles inserted into the holding holes can be prevented or suppressed.

According to the present invention, there is provided a grinding element bundle holder of a wheel brush for holding end portions, at an inner circumferential side, of a plurality of grinding element bundles that are radially arrayed about a rotational center line, the grinding element bundle holder including an annular grinding element bundle-holding surface that faces an outer circumferential side while surrounding the rotational center line, wherein the grinding element bundle-holding surface has a plurality of holding holes arrayed in a circumferential direction, first protrusions protruding to the outer circumferential side are provided on first opening edge portions adjacent to the holding holes at one side in the rotational center line direction in opening edges of the holding holes in the grinding element bundle-holding surface, and end portions of the grinding element bundles at the inner circumferential side are inserted into and held in the holding holes.

According to the invention, the first protrusions are provided on the first opening edge portions adjacent to the holding holes in the rotational center line direction in the grinding element holding surface of the grinding element bundle holder. Accordingly, in a work operation on a workpiece while the wheel brush configured by holding the grinding element bundles on the grinding element bundle holder is rotated about the rotational center line, when the grinding element bundles are about to expand to one side in the rotational center line direction, the grinding element bundles that start to bend abut against the first protrusions. The abutment suppresses the expansion of the grinding element bundles to the one side, so that excessive curve of the grinding elements such as wire-shaped grinding elements configuring the grinding element bundles in the rotational center line direction and breaking thereof can be suppressed in the work operation. The expansion of the grinding element bundles in the rotational center line direction is suppressed, whereby lowering of grinding force of grinding and polishing the surface of the workpiece by the wheel brush can be suppressed in the work operation.

DESCRIPTION OF EMBODIMENTS

Hereinafter, a wheel brush according to an embodiment of the present invention will be described with reference to the accompanying drawings.

Overall Configuration

Figure 1:
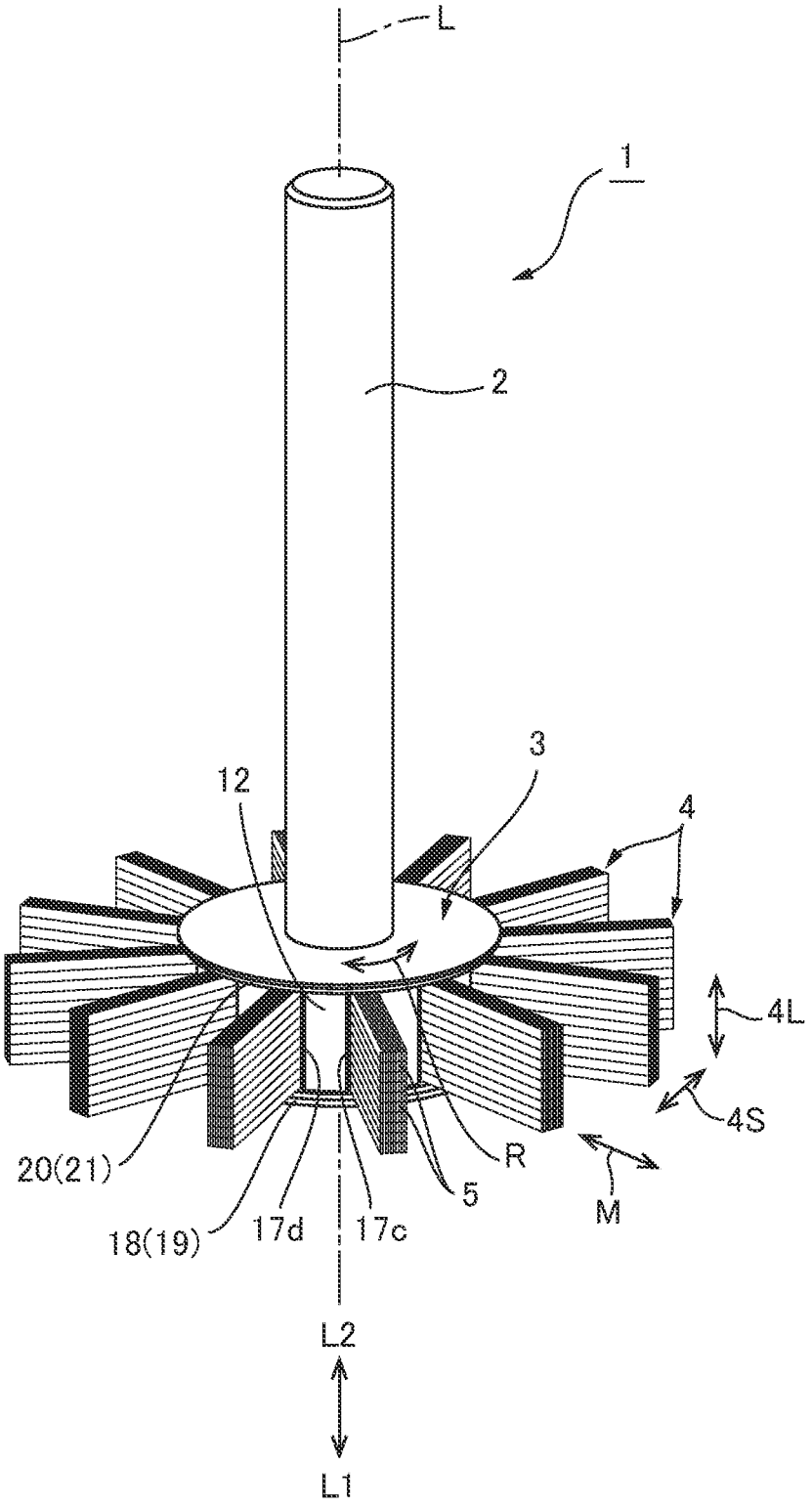
FIG. 1 is a perspective view of a wheel brush to which the present invention is applied.

FIG. 1 is a perspective view of the wheel brush according to a first embodiment to which the present invention is applied. The wheel brush in the embodiment includes a shank 2, an annular grinding element bundle holder 3 that is concentrically fixed to one end portion of the shank 2, and a plurality of grinding element bundles 4 that are radially arrayed about an axial line L (rotational center line of a wheel brush 1) of the shank 2. Each of the grinding element bundles 4 is formed by gathering a plurality of wire-shaped grinding elements 5 arranged in parallel. In the grinding element bundle 4, element axial directions M of the wire-shaped grinding elements 5 are directed to a direction orthogonal to the axial line L of the shank 2. The grinding element bundle holder 3 holds end portions of the grinding element bundles 4 at the inner circumferential side. In the following description, the side at which the grinding element bundle holder 3 is located in the axial line L direction of the wheel brush 1 is set to be a first direction L1 and the opposite side to the first direction L1 is set to be a second direction L2.

Grinding Element Bundle Holder

Figure 2:
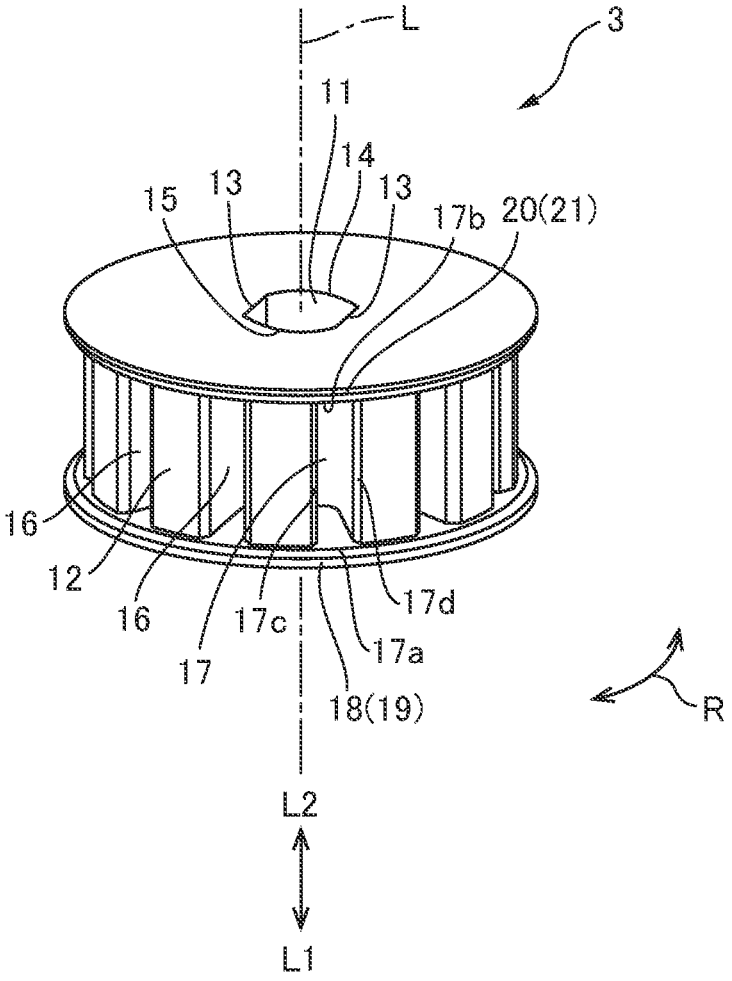
FIG. 2 is a perspective view of a grinding element bundle holder.

FIG. 2 is a perspective view of the grinding element bundle holder. As illustrated in FIG. 2, the grinding element bundle holder 3 has an annular shape and includes a center hole 11 concentric with the axial line L and an annular grinding element bundle-holding surface 12 concentric with the axial line L and facing the outer circumferential side. The grinding element bundle holder 3 is made of resin. A contour shape of the center hole 11 of the grinding element bundle holder 3 when viewed from the axial line L direction has a pair of linear contour portions 13 extending in parallel in the direction orthogonal to the axial line L with the axial line L interposed therebetween, a first circular arc contour portion 14 connecting one end portions of the pair of linear contour portions 13, and a second circular arc contour portion 15 connecting the other end portions of the pair of linear contour portions 13. The shank 2 includes, on an end portion in the first direction L1, a mounting portion (not illustrated) that is fitted into the center hole 11 of the grinding element bundle holder 3, and is fixed to the grinding element bundle holder 3 in a state in which the mounting portion is inserted into the center hole 11.

The grinding element bundle-holding surface 12 includes a plurality of holding holes 16 arrayed in a circumferential direction R. Each holding hole 16 is recessed to the inner circumferential side in the radial direction. Openings 17 of the holding holes 16 in the grinding element bundle-holding surface 12 are rectangular and have oblong shapes with the widths thereof in the circumferential direction R smaller than the heights thereof in the axial line L direction. The holding holes 16 are provided at equivalent intervals in the circumferential direction R. End portions of the grinding element bundles 4 at the inner circumferential side are inserted into the holding holes 16.

First protrusions 18 protruding to the outer circumferential side are provided on first opening edge portions 17*a* adjacent to the holding holes 16 at the first direction L1 side in the opening edges of the holding holes 16 in the grinding element bundle-holding surface 12. In the embodiment, the respective first protrusions 18 are continuous to the first protrusions 18 adjacent thereto in the circumferential direction R to configure an annular first flange portion 19. Second protrusions 20 protruding to the outer circumferential side are provided on second opening edge portions 17*b* adjacent to the holding holes 16 at the second direction L2 side in the opening edges of the holding holes 16 in the grinding element bundle-holding surface 12. In the embodiment, the respective second protrusions 20 are continuous to the second protrusions 20 adjacent thereto in the circumferential direction R to configure an annular second flange portion 21.

Circumferential direction opening edge portions 17*c* and 17*d* that are located adjacent to the holding holes 16 in the circumferential direction R in the opening edges of the holding holes 16 in the grinding element bundle-holding surface 12 are inclined to the inner circumferential side toward the holding holes 16. In the embodiment, both of the circumferential direction opening edge portions 17*c* and 17*d* located at both sides of the holding holes 16 in the circumferential direction R are curved surfaces having protruding shapes (R shapes) inclined to the inner circumferential side toward the holding holes 16. The circumferential direction opening edge portions 17*c* and 17*d* can be flat inclined surfaces inclined to the inner circumferential side toward the holding holes 16.

Figure 3:
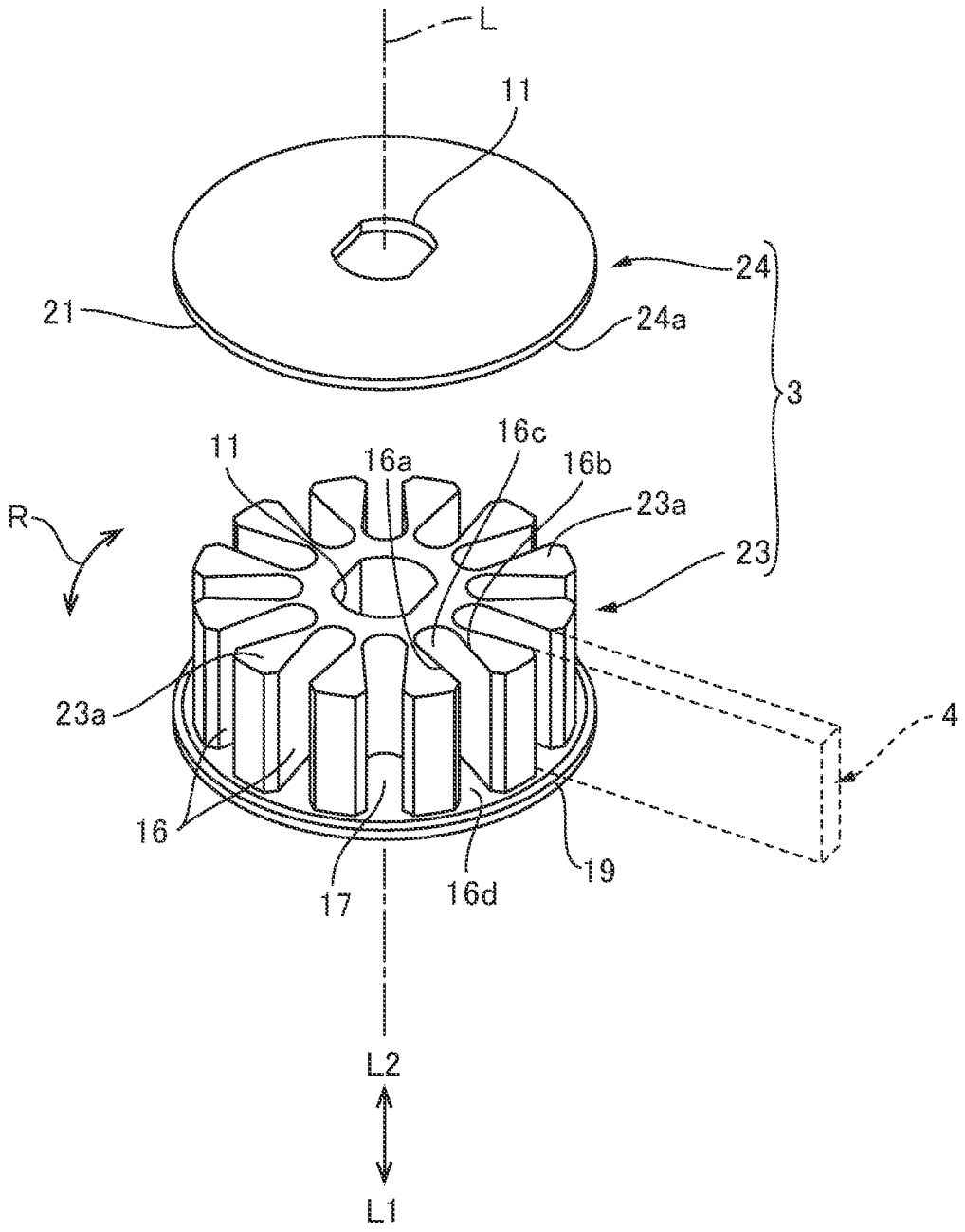
FIG. 3 is an exploded perspective view of the grinding element bundle holder.

FIG. 3 is an exploded perspective view of the grinding element bundle holder 3. As illustrated in FIG. 3, the grinding element bundle holder 3 includes a first holder member 23 and a second holder member 24 laminated in the axial line L direction. The first holder member 23 includes the holding holes 16 and the first flange portion 19. The second holder member 24 includes the second flange portion 21.

The holding holes 16 are opened in a lamination surface 23*a* (end surface of the first holder member 23 at the second direction L2 side) of the first holder member 23 on which the second holder member 24 is overlapped. That is to say, in the first holder member 23, the holding holes 16 are divided by first inner wall surfaces 16*a* and second inner wall surfaces 16*b* opposing each other in the circumferential direction R, third inner wall surfaces 16*c* connecting the ends of the first inner wall surfaces 16*a* at the inner circumferential side and the ends of the second inner wall surfaces 16*b* at the inner circumferential side, and fourth inner wall surfaces 16*d* connecting the ends of the first inner wall surfaces 16*a* at the first direction L1 side, the ends of the second inner wall surfaces 16*b* at the first direction L1 side, and the ends of the third inner wall surfaces 16*c* at the first direction L1 side. Intervals between the first inner wall surfaces 16*a* and the second inner wall surfaces 16*b* of the holding holes 16 are enlarged toward the third inner wall surfaces 16*c* (inner circumferential side) from the grinding element bundle-holding surface 12. In other words, the first inner wall surfaces 16*a* are inclined in the direction away from the second inner wall surfaces 16*b* toward the inner circumferential side and the second inner wall surfaces 16*b* are inclined in the direction away from the first inner wall surfaces 16*a* toward the inner circumferential side. Center portions of the third inner wall surfaces 16*c* in the circumferential direction R are curved to the inner circumferential side.

A surface 24*a* of the second holder member 24 at the first direction L1 side is a flat surface. When the second holder member 24 is laminated on the first holder member 23, the second holder member 24 seals the openings of the holding holes 16 in the lamination surface 23*a*. The holding holes 16 thereby include only the openings 17 in the grinding element bundle-holding surface 12.

Grinding Element Bundle

Figure 4A:
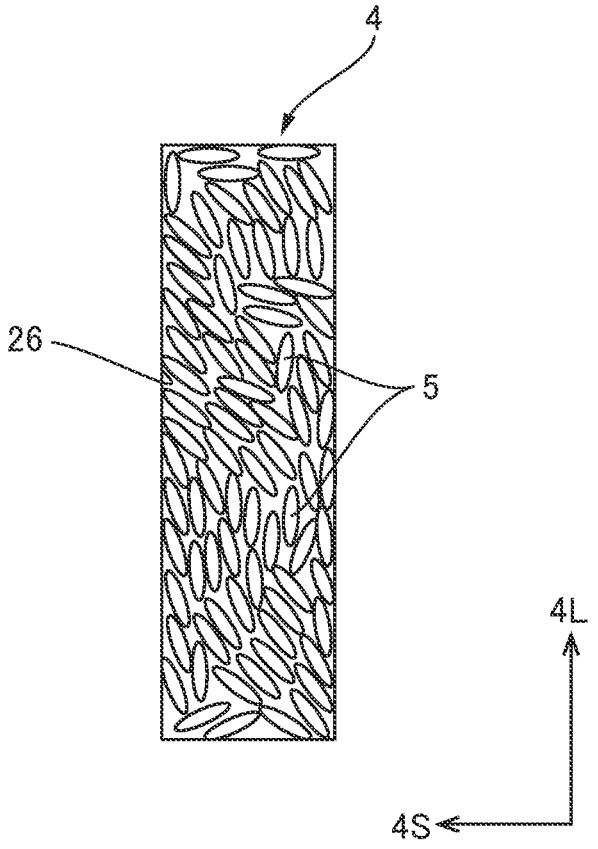
FIG. 4 is a cross-sectional view of a grinding element bundle and is a cross-sectional view of wire-shaped grinding elements.
Figure 4B:
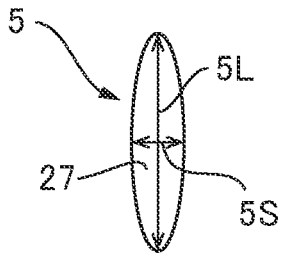
Figure 5:
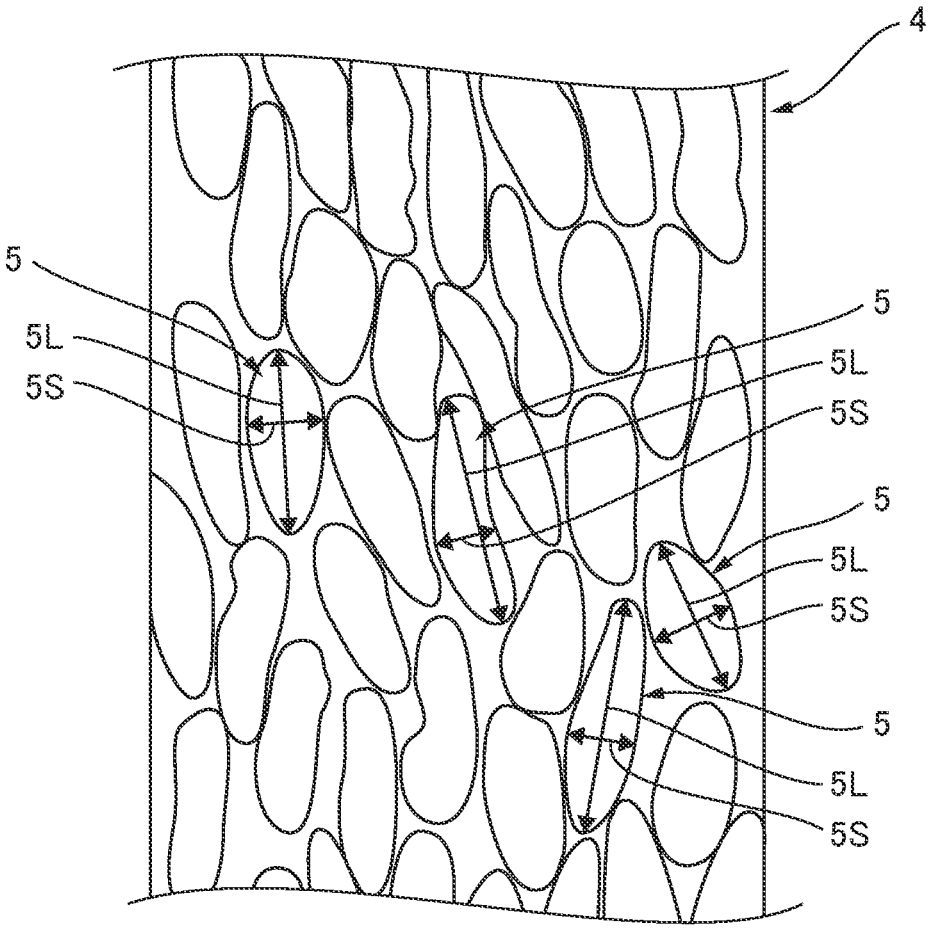
FIG. 5 is an enlarged cross-sectional view illustrating a part of a grinding element bundle cross section in an enlarged manner.

FIG. 4A is a cross-sectional view schematically illustrating a grinding element bundle cross section when the grinding element bundle 4 is cut along a plane (plane parallel to the axial line L) orthogonal to the element axial direction M of the wire-shaped grinding elements 5, and FIG. 4B is a cross-sectional view schematically illustrating a grinding element cross section when the wire-shaped grinding elements 5 are cut along the plane (plane parallel to the axial direction L) orthogonal to the element axial direction M. FIG. 5 is an enlarged cross-sectional view illustrating a part of the grinding element bundle cross section in an enlarged manner. In FIG. 5, contours of the grinding element cross sections in the actual grinding element bundle cross section are traced for illustration.

As illustrated in FIG. 1, the grinding element bundles 4 protrude to the outer circumferential side from the grinding element bundle-holding surface 12 while the end portions thereof at the inner circumferential side are inserted into the holding holes 16. A grinding element bundle cross section 26 when each grinding element bundle 4 is cut in the direction (axial line L direction) orthogonal to the wire-shaped grinding elements 5 has a flattened shape corresponding to the shape of the opening 17 of each holding hole 16, as illustrated in FIG. 4A. That is to say, the grinding element bundle cross section 26 of the gathered wire-shaped grinding elements 5 (grinding element bundle 4) is such oblong shape that the width in the circumferential direction R is smaller than the height in the axial line L direction.

Each wire-shaped grinding element 5 is an assembly of inorganic filaments solidified with resin. To be more specific, each wire-shaped grinding element 5 is formed into a wired shape by impregnating and hardening the assembly of inorganic filaments such as alumina fibers with binder resin such as epoxy resin and silicone resin. The filament assembly is a group of 250 to 3000 alumina filaments (inorganic filaments) with a fiber diameter of 8 μm to 50 μm. The inorganic filament is not particularly limited as long as it is a material having polishing performance with respect to a to-be-polished material, that is, a material being harder and brittler than a material to be polished, and for example, silicon carbide fibers, boron fibers, or glass fibers can be used instead of the alumina fibers.

As illustrated in FIG. 4B and FIG. 5, the wire-shaped grinding elements 5 have flattened-shaped grinding element cross sections 27 orthogonal to the element axial directions M thereof. The flattened shape is such shape that a distance from the center of the grinding element cross section 27 to the outer periphery thereof is not constant and the length of the grinding element cross section 27 in a lengthwise direction 5L and the length thereof in a short-side direction 5S are different from each other. As illustrated in FIG. 5, the lengthwise directions 5L of the grinding element cross sections 27 are directions in which longest portions of the grinding element cross sections 27 extend. The short-side directions 5S of the grinding element cross sections 27 are orthogonal to the lengthwise directions 5L thereof. A flatness ratio of the grinding element cross section 27 of each of the wire-shaped grinding elements 5 configuring the grinding element bundle 4 is equal to or higher than 1.1 and equal to or lower than 8.0. The flatness ratio is a value provided by dividing the dimension of the grinding element cross section 27 in the lengthwise direction 5L by the dimension thereof in the short-side direction 5S. The dimension of the grinding element cross section 27 in the lengthwise direction 5L is the dimension of the longest portion of the grinding element cross section 27. The dimension in the short-side direction 5S is the dimension of a portion having the largest width in the direction orthogonal to the lengthwise direction 5L.

The flattened-shaped wire-shaped grinding elements 5 can be manufactured by impregnating the filament assembly with an unsolidified resin binder, and then, subjecting the filament assembly to a dicing machine to shape it into a predetermined flat shape. When a process of twisting the filament assembly is performed before the impregnation of the filament assembly with the unsolidified resin binder, the inorganic filaments in the filament assembly are made into a state of being gathered in response to the twisting amount and the cross-sectional shapes of the wire-shaped grinding elements 5 are easy to be controlled.

When two directions of each grinding element bundle 4 that are orthogonal to the element axial directions M and orthogonal to each other are assumed to be a grinding element bundle short-side direction 4S and a grinding element bundle lengthwise direction 4L, the short-side directions 5S of the grinding element cross sections 27 of equal to or higher than 75% of the wire-shaped grinding elements 5 are directed to the grinding element bundle short-side direction 4S. "The short-side direction 5S of the grinding element cross section 27 of the wire-shaped grinding element 5 is directed to the grinding element bundle short-side direction 4S" indicates that an angle difference between the grinding element bundle short-side direction 4S and the short-side direction 5S of the grinding element cross section 27 is smaller than 45°.

Wheel Brush Manufacturing Method

When the wheel brush 1 is manufactured, the grinding element bundles 4 are formed by gathering the wire-shaped grinding elements 5 so as to cause the grinding element bundle cross sections 26 to have the flattened shapes. When the wire-shaped grinding elements 5 are gathered or after the wire-shaped grinding elements 5 are gathered, pressure is applied to these wire-shaped grinding elements 5 from the direction orthogonal to the element axial directions M of the respective wire-shaped grinding elements 5. In the embodiment, the pressure is applied while pinching the wire-shaped grinding elements 5 (grinding element bundles) gathered so as to cause the grinding element bundle cross section 26 to have the flattened shape with a jig at both sides in the grinding element bundle short-side direction 4S. The wire-shaped grinding elements 5 are thereby oriented. In the embodiment, the pressure is applied from the grinding element bundle short-side directions 4S until the short-side directions 5S of the grinding element cross sections 27 of equal to or higher than 75% of the wire-shaped grinding elements 5 are directed to the grinding element bundle short-side directions 4S. An orientation ratio of the grinding element bundles 4 can be changed by adjusting the pressure that is applied to the wire-shaped grinding elements 5. For example, equal to or higher than 90% of the wire-shaped grinding elements 5 in the grinding element bundles 4 can also be oriented such that the cross-sectional shapes thereof are directed to a predetermined direction.

Then, the grinding element bundle holder 3 is caused to hold the grinding element bundles 4. To be more specific, the holding holes 16 of the first holder member 23 are filled with the adhesive, and then, the end portions of the grinding element bundles 4 are inserted into the holding holes 16.

When the holding holes 16 are caused to hold the grinding element bundles 4, the end portions of the grinding element bundles 4 at the inner circumferential side are inserted into the holding holes 16 from the outer circumferential side of the first holder member 23 and the second direction L2 side. The grinding element bundles 4 are inserted into the holding holes 16 while causing the grinding element bundles 4 to abut against the first flange portion 19 as indicated by dotted lines in FIG. 3. The first flange portion 19 thereby supports the grinding element bundles 4 from the first direction L1 side and functions as the guiding portion guiding the grinding element bundles 4 to the inner circumferential side of the holding holes 16. When the grinding element bundles 4 are inserted into the holding holes 16, the circumferential direction opening edge portions 17*c* and 17*d* of the grinding element bundle-holding surface 12 guide the grinding element bundles 4 to the inner side of the holding holes 16. Accordingly, the grinding element bundles 4 are easily inserted into the holding holes 16.

The grinding element bundles 4 are made into such postures that the grinding element bundle short-side directions 4S are directed to the circumferential direction R when being inserted into the holding holes 16. Accordingly, equal to or higher than 75% of the wire-shaped grinding elements 5 configuring the grinding element bundles 4 are oriented such that the short-side directions 5S of the grinding element cross sections 27 thereof are directed to the circumferential direction R of the grinding element bundle holder 3.

Thereafter, the adhesive is applied to the lamination surface 23*a* of the first holder member 23, and the second holder member 24 is put thereon. The openings of the holding holes 16 in the lamination surface 23*a* are thereby sealed and the second holder member 24 is fixed to the first holder member 23. Accordingly, the grinding element bundle holder 3 is caused to hold the grinding element bundles 4 that are annularly arrayed.

The grinding element bundle holder 3 may be caused to hold the grinding element bundles 4 as follows. That is, first, the first holder member 23 and the second holder member 24 are bonded to each other to configure the grinding element bundle holder 3, and then, the holding holes 16 are filled with the adhesive. Thereafter, the end portions of the grinding element bundles 4 are inserted into the holding holes 16 from the outer circumferential side of the grinding element bundle holder 3.

Subsequently, the end portion of the shank 2 at the first direction L1 side is inserted into the center hole 11 of the grinding element bundle holder 3. After that, the shank 2 is fixed to the grinding element bundle holder 3 to integrate the grinding element bundle holder 3 and the shank 2 with each other.

Work Method with Wheel Brush

Figure 6:
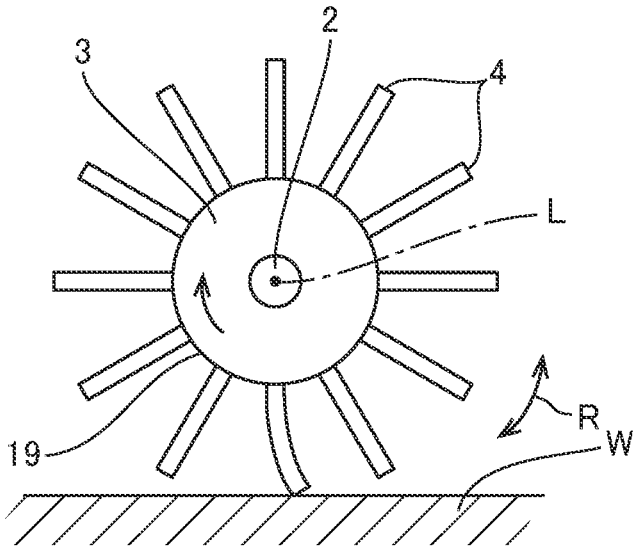
FIG. 6 is a descriptive view for explaining a method for working a workpiece with the wheel brush.

FIG. 6 is a descriptive view for explaining a working direction of the workpiece with the wheel brush 1. In FIG. 6, the wheel brush 1 is viewed from the first direction L1. In the work on a workpiece W using the wheel brush 1, the shank 2 is coupled to a head of a machine tool and the wheel brush 1 is rotated about the axial line L of the shank 2. Then, the end portions of the grinding element bundles 4 at the outer circumferential side are brought into contact with the workpiece W to grind and polish the workpiece W.

When the grinding element bundles 4 are about to expand in the first direction L1 of the axial line L direction in the work operation on the workpiece W, the wire-shaped grinding elements 5 that start to bend in the first direction L1 abut against the first protrusions 18 (first flange portion 19). Further deformation of the wire-shaped grinding elements 5 are thereby suppressed, so that expansion of the grinding element bundles 4 in the first direction L1 is suppressed. In the same manner, when the grinding element bundles 4 are about to expand in the second direction L2 of the axial line L direction in the work operation on the workpiece W, the wire-shaped grinding elements 5 that start to bend in the second direction L2 abut against the second protrusions 20. Further deformation of the wire-shaped grinding elements 5 are thereby suppressed, so that expansion of the grinding element bundles 4 in the second direction L2 is suppressed. Excessive curve, in the axial line L direction, of the wire-shaped grinding elements 5 of the grinding element bundles 4 protruding to the outer circumferential side from the grinding element bundle holder 3 and breaking thereof can be suppressed in the work operation of grinding and polishing the workpiece W. The expansion of the grinding element bundles 4 in the axial line L direction is suppressed, whereby lowering of grinding force of grinding and polishing the surface of the workpiece W with the wheel brush 1 can be suppressed in the work operation.

In the embodiment, the protrusions 18 and 20 provided on the opening edges of the holding holes 16 are continuous in the circumferential direction R to configure the annular first flange portion 19 and second flange portion 21. Expansion of the grinding element bundles 4 in the first direction L1 and the second direction L2 can therefore be suppressed even when the grinding element bundles 4 are curved in the circumferential direction R in the work operation.

In the embodiment, the circumferential direction opening edge portions 17*c* and 17*d* of the holding holes 16 in the grinding element bundle-holding surface 12 are inclined to the inner circumferential side toward the holding holes 16, so that the grinding element bundles 4 held in the holding holes 16 are easy to be curved in the circumferential direction R. The grinding element bundles 4 are thereby easy to be deflected in the work operation in which the wheel brush 1 is rotated to bring the front end portions of the grinding element bundles 4 into contact with the workpiece W. The deflection of the grinding element bundles 4 can release the load on the grinding element bundles 4 from the workpiece side in the work operation, whereby the breaking of the wire-shaped grinding elements 5 configuring the grinding element bundles 4 can be suppressed.

In the embodiment, the grinding element bundles 4 have the flattened-shaped (oblong) grinding element bundle cross sections 26 and the grinding element bundle short-side directions 4S of the grinding element bundle cross sections 26 are directed to the circumferential direction R. Accordingly, the grinding element bundles 4 are easy to be deflected in the circumferential direction R as compared with the case in which the grinding element bundle cross sections 26 do not have the flattened shapes and the case in which the grinding element bundle holder 3 holds the grinding element bundles 4 while the grinding element bundle lengthwise directions 4L of the grinding element bundle cross sections 26 are directed to the circumferential direction R.

Furthermore, in the embodiment, all of the wire-shaped grinding elements 5 configuring the grinding element bundles 4 held by the grinding element bundle holder 3 have the flattened-shaped grinding element cross sections 27, and equal to or higher than 75% of the wire-shaped grinding elements 5 are oriented such that the short-side directions 5S of the grinding element cross sections 27 are directed to the circumferential direction R. The wire-shaped grinding elements 5 having the flattened cross-sectional shapes are easy to be deflected in the short-side directions 5S of the grinding element cross sections 27 as compared with the wire-shaped grinding elements 5 the cross-sectional shapes of which are not flattened. Accordingly, the grinding element bundles 4 in the embodiment in which equal to or higher than 75% of all of the wire-shaped grinding elements 5 are oriented such that the short-side directions 5S of the grinding element cross sections 27 are directed to the circumferential direction R are easy to be deflected in the circumferential direction R as compared with the conventional grinding element bundles in which the wire-shaped grinding elements 5 are not oriented.

In the embodiment, the grinding element bundles 4 are thus easy to be deflected in the circumferential direction R when the wheel brush 1 is rotated to bring the front end portions of the grinding element bundles 4 into contact with the workpiece W. The deflection of the grinding element bundles 4 can release the load on the grinding element bundles 4 from the workpiece side in the work operation, whereby the breaking of the wire-shaped grinding elements 5 configuring the grinding element bundles 4 can be suppressed. Furthermore, deep cutting setting can be performed in the work operation on the workpiece W because the grinding element bundles 4 are easy to be deflected. In addition, severe scratches on the surface of the workpiece W can be avoided in the work operation because the grinding element bundles 4 are easy to be deflected.

In the embodiment, the grinding element bundles 4 held by the grinding element bundle holder 3 are hardly deflected in the axial line L direction as compared with the conventional grinding element bundles in which the wire-shaped grinding elements 5 are not oriented. That is to say, the grinding element bundles 5 having the flattened-shaped cross-sectional shapes are easy to be deflected in the short-side directions 5S of the grinding element cross sections 27 and are hardly deflected in the lengthwise directions 5L. The expansion of the grinding element bundles 4 in the axial line L direction (grinding element bundle lengthwise directions 4L) can therefore be suppressed in the work operation, whereby lowering of the grinding force due to the expansion of the grinding element bundles 4 can be suppressed.

In the embodiment, the first holder member 23 includes the first flange portion 19, so that the first flange portion 19 can guide the grinding element bundles 4 into the holding holes 16 by causing the grinding element bundles 4 to abut against the first flange portion 19 when the grinding element bundles 4 are inserted into the holding holes 16 of the first holder member 23. The grinding element bundles 4 can therefore be easily held by the grinding element bundle holder 3 by inserting them into the holding holes 16. Furthermore, the circumferential direction opening edge portions 17*c* and 17*d* of the grinding element bundle-holding surface 12 are inclined to the inner circumferential side toward the holding holes 16. The circumferential direction opening edge portions 17*c* and 17*d* therefore serve as the guiding surfaces guiding the grinding element bundles 4 into the holding holes 16 in the insertion of the grinding element bundles 4 into the holding holes 16 from the outer circumferential side and the insertion is easily performed. Accordingly, the wheel brush 1 is easily manufactured.

In the embodiment, the intervals between the first inner wall surfaces 16*a* and the second inner wall surfaces 16*b* that oppose each other in the circumferential direction R in the holding holes 16 are enlarged toward the inner circumferential side. With this configuration, the spaces that are filled with the adhesive interposed between the grinding element bundles 4 and the grinding element bundle holder 3 are formed at the deep side (inner circumferential side) of the holding holes 16. Accordingly, the anchor effect of the adhesive filling the spaces can prevent or suppress disengagement of the grinding element bundles 4 inserted into the holding holes 16. The third inner wall surfaces 16*c* are curved, so that the adhesion areas between the third inner wall surfaces 16*c* and the grinding element bundles 4 can be increased. Accordingly, disengagement of the grinding element bundles 4 inserted into the holding holes 16 can be prevented or suppressed.

When the predetermined ratio of the wire-shaped grinding elements 5 configuring the grinding element bundles 4 are oriented such that the short-side directions 5S of the grinding element cross sections 27 are directed to the grinding element bundle short-side directions 4S of the grinding element bundle cross sections 26 of the grinding element bundles 4, the grinding element bundles 4 are easier to be deflected in the grinding element bundle short-side directions 4S as compared with the case in which the wire-shaped grinding elements 5 are not oriented. The easiness of the deflection of the grinding element bundles 4 in the grinding element bundle short-side directions 4S is improved only by orienting some of the wire-shaped grinding elements 5 configuring the grinding element bundles 4 such that the short-side directions 5S of the grinding element cross sections 27 thereof are directed to the grinding element bundle short-side directions 4S. When the ratio of the wire-shaped grinding elements 5 oriented such that the short-side directions 5S of the grinding element cross sections 27 thereof are directed to the grinding element bundle short-side directions 4S among the wire-shaped grinding elements 5 configuring the grinding element bundles 4 is increased, the easiness of the deflection of the grinding element bundles 4 in the grinding element bundle short-side directions 4S is also improved. The deflection of the grinding element bundles 4 can release the load on the grinding element bundles 4 from the workpiece side in the work operation, whereby the breaking of the wire-shaped grinding elements 5 configuring the grinding element bundles 4 can be suppressed.

The following Table 1 indicates results of evaluation of improvement in the grinding force and occurrence of the breaking of the wire-shaped grinding elements 5 in the grinding element bundles 4 by working the workpiece W using the wheel brush 1 in the embodiment. In the evaluation, the orientation ratio of the wire-shaped grinding elements 5 configuring the grinding element bundles 4 of the wheel brush 1 is changed between 0 and 100%. The flatness ratio of the wire-shaped grinding elements 5 is 4. In the wheel brush 1 in which the orientation ratio of the wire-shaped grinding elements 5 is 100%, the short-side directions 5S of the grinding element cross sections 27 of all of the wire-shaped grinding elements 5 configuring the grinding element bundles 4 are directed to the grinding element bundle short-side directions 4S of the grinding element bundle cross sections 26 of the grinding element bundles 4 and the grinding element bundle short-side directions 4S are directed to the circumferential direction R. In the evaluation, the workpiece as a work target is S50C (carbon steel for mechanical structure). The work on the workpiece is round chamfering work. The rotating speed of the wheel brush 1 in the work operation is 2000 $min^{-1}$. The cutting amount is 1.0 mm. The grinding force is indicated by surface roughness (maximum height) Ry after the work. The breaking of the wire-shaped grinding elements 5 is indicated by visually measuring the number of the broken wire-shaped grinding elements 5 after work operation time has elapsed. The surface roughness Ry of the workpiece before the work is 5.0 μm. The work operation time is 0.2 minutes.

TABLE 1

| | ORIENTATION RATIO (%) | | | | | | | | | | |
|---|---|---|---|---|---|---|---|---|---|---|---|
| | 0 | 10 | 20 | 30 | 40 | 50 | 60 | 70 | 80 | 90 | 100 |
| GRINDING ELEMENT BUNDLE DEFLECTION (mm) | 0.1 | 1.2 | 1.5 | 2.5 | 3.3 | 3.8 | 4.3 | 4.5 | 4.6 | 4.7 | 5.0 |
| BREAKING (PIECE) | 10 | 5 | 4 | 3 | 2 | 1 | 0 | 0 | 0 | 0 | 0 |
| SURFACE ROUGHNESS Ry (μm) | 4.9 | 4.3 | 4.1 | 3.9 | 3.6 | 3.3 | 2.7 | 2.6 | 2.4 | 2.3 | 2.2 |

With the evaluation, it is found that the orientation of the wire-shaped grinding elements 5 facilitates the deflection of the grinding element bundles 4 and suppresses the breaking of the wire-shaped grinding elements 5 in the work operation. It is found that increase in the orientation ratio of the wire-shaped grinding elements 5 improves the effect of suppressing the breaking of the wire-shaped grinding elements 5 in the work operation. For example, when equal to or higher than 60% of the wire-shaped grinding elements 5 are oriented and the short-side directions 5S of the grinding element cross sections 27 of the oriented wire-shaped grinding elements 5 and the grinding element bundle short-side directions 4S are directed to the circumferential direction R, the wire-shaped grinding elements 5 are not broken in the work operation.

The following Table 2 indicates results of evaluation of improvement in the grinding force and occurrence of the breaking and cracking of the wire-shaped grinding elements 5 in the grinding element bundles 4 by working the workpiece W using the wheel brush. In the evaluation, the orientation ratio of the wire-shaped grinding elements 5 is set to 60% and the flatness ratio of the wire-shaped grinding elements 5 configuring the grinding element bundles 4 of the wheel brush 1 is changed between 1.1 and 10. In the evaluation, the workpiece as a work target is S50C (carbon steel for mechanical structure). The work on the workpiece is round chamfering work. The rotating speed of the wheel brush 1 in the work operation is 2000 $min^{-1}$. The cutting amount is 1.0 mm. The grinding force is indicated by the surface roughness (maximum height) Ry after the work. The breaking of the wire-shaped grinding elements 5 is indicated by visually measuring the number of the broken wire-shaped grinding elements 5 after work operation time has elapsed. The cracking of the wire-shaped grinding elements 5 is indicated by visually measuring the number of the cracked wire-shaped grinding elements 5 in the element axial direction after the work operation time has elapsed. The surface roughness Ry of the workpiece before the work is 5.0 μm. The work operation time is 0.2 minutes. Table 2 indicates, as a reference, evaluation when the grinding element cross sections 27 of the wire-shaped grinding elements 5 configuring the grinding element bundles 4 are square (when the flatness ratio is 1).

TABLE 2

| | FLATNESS RATIO (%) | | | | | | | | |
|---|---|---|---|---|---|---|---|---|---|
| | 1.0 | 1.1 | 1.3 | 1.5 | 2 | 4 | 6 | 8 | 10 |
| GRINDING ELEMENT BUNDLE DEFLECTION (mm) | 0.5 | 1.5 | 2.8 | 3.5 | 4.0 | 4.3 | 4.5 | 4.7 | 5.0 |
| BREAKING (PIECE) | 6 | 3 | 2 | 1 | 0 | 0 | 0 | 0 | 0 |
| CRACKING (PIECE) | 0 | 0 | 0 | 0 | 0 | 0 | 0 | 1 | 5 |
| SURFACE ROUGHNESS Ry (μm) | 4.5 | 4.0 | 3.5 | 3.1 | 2.8 | 2.7 | 2.4 | 2.3 | 2.6 |

With the evaluation, it is found that usage of the wire-shaped grinding elements 5 having a high flatness ratio facilitates the deflection of the grinding element bundles 4 and suppresses the breaking of the wire-shaped grinding elements 5 in the work operation. When the flatness ratio of the wire-shaped grinding elements 5 configuring the grinding element bundles 4 is in a range of 1.1 to 10, the grinding force Ry is lowered but the surface of the workpiece is not severely scratched as compared with the case in which the flatness ratio of the wire-shaped grinding elements 5 is 1. When the flatness ratio of the wire-shaped grinding elements 5 configuring the grinding element bundles 4 is in a range of 2 to 10, the wire-shaped grinding elements 5 in the grinding element bundles 4 are not broken. When the flatness ratio of the wire-shaped grinding elements 5 configuring the grinding element bundles 4 is 8, the cracking of the wire-shaped grinding elements 5 is observed. When the flatness ratio of the wire-shaped grinding elements 5 configuring the grinding element bundles 4 is 10, the number of the cracked wire-shaped grinding elements 5 is increased.

Modifications

Although the flange portions 19 and 21 are provided at both sides, in the axial line L direction, of the holding holes 16 in the grinding element bundle-holding surface 12 in the above-mentioned embodiment, provision of at least one of the flange portions 19 and 21 restricts expansion of the grinding element bundles 4 to the side at which the flange portion is provided, whereby the breaking of the wire-shaped grinding elements 5 can be suppressed.

Although the first protrusions 18 formed adjacent to the holding holes 16 at the first direction L1 side are continuous in the circumferential direction R to configure the annular first flange portion 19, the first protrusions 18 may be independently provided on the first opening edge portions 17*a* of the holding holes 16 in the grinding element bundle-holding surface 12. In the same manner, although the second protrusions 20 formed adjacent to the holding holes 16 at the second direction L2 side are continuous in the circumferential direction R to configure the annular second flange portion 21, the second protrusions 20 may be independently provided on the second opening edge portions 17*b* of the holding holes 16 in the grinding element bundle-holding surface 12.

Although the circumferential direction opening edge portions 17*c* and 17*d* of the holding holes 16 are the inclined surfaces inclined toward the holding holes 16 in the above-mentioned embodiment, the inclination surfaces may be omitted. The first inner wall surfaces 16*a* and the second inner wall surfaces 16*b* of the holding holes may extend in parallel. The third inner wall surfaces 16*c* may be flat surfaces.

Although the grinding element bundle holder 3 is made of resin in the above-mentioned embodiment, the grinding element bundle holder 3 can be made of metal. With this configuration, the rigidity of the grinding element bundle holder 3 can be improved. In the grinding element bundle holder 3, the first flange portion 19 and the second flange portion 21 can be made of resin and portions other than the first flange portion 19 and the second flange portion 21 can be made of metal. With this configuration, the rigidity of the grinding element bundle holder 3 can be improved and the breaking of the wire-shaped grinding elements 5 when the wire-shaped grinding elements 5 abut against the first flange portion 19 and the second flange portion 21 can be prevented.

Although the grinding element bundle-holding surface 12 has the annular shape in the above-mentioned embodiment, it may be an annular surface having polygonal contours when seen from the axial line L direction.

The openings 17 of the holding holes 16 in the grinding element bundle-holding surface 12 can have flattened shapes such as elliptical shapes and oval shapes and the grinding element bundles 4 can have the grinding element bundle cross sections 26 having flattened shapes corresponding to the openings 17 of the holding holes 16. The openings 17 of the holding holes 16 in the grinding element bundle-holding surface 12 have flattened shapes formed by triangular shapes, trapezoidal shapes, or pentagonal or higher-order polygonal shapes and the grinding element bundles 4 can have the grinding element bundle cross sections 26 having flattened shapes corresponding to the openings 17 of the holding holes 16. The openings 17 of the holding holes 16 in the grinding element bundle-holding surface 12 may have triangular shapes, regular polygonal shapes such as square shapes, or circular shapes and the grinding element bundles 4 may have the grinding element bundle cross sections 26 having triangular shapes, regular polygonal shapes, or circular shapes corresponding to the openings 17 of the holding holes 16. The wire-shaped grinding elements 5 having the square or circular grinding element cross sections 27 may be used to configure the grinding element bundles 4.

At least one of the first inner wall surfaces 16*a* and the second inner wall surfaces 16*b* of the holding holes 16 may have recesses recessed in the direction away from the other. FIG. 7 is a descriptive view for explaining the grinding element bundle holder 3 in modifications in which the shapes of the first inner wall surface 16*a* and the second inner wall surface 16*b* dividing each holding hole 16 are changed. In FIG. 7, the opening portion of each holding hole 16 that is exposed to the lamination surface 23*a* of the first holder member 23 is seen from the axial line L direction.

Figure 7A:
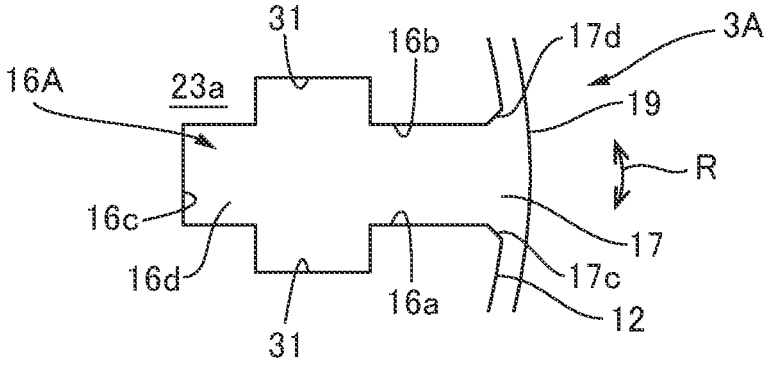
FIG. 7 is a descriptive view for explaining grinding element bundle holders in modifications in which shapes of inner wall surfaces of each holding hole are changed.
Figure 7B:
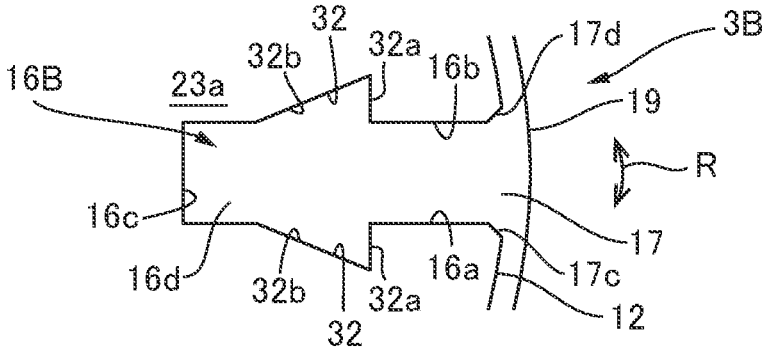
Figure 7C:
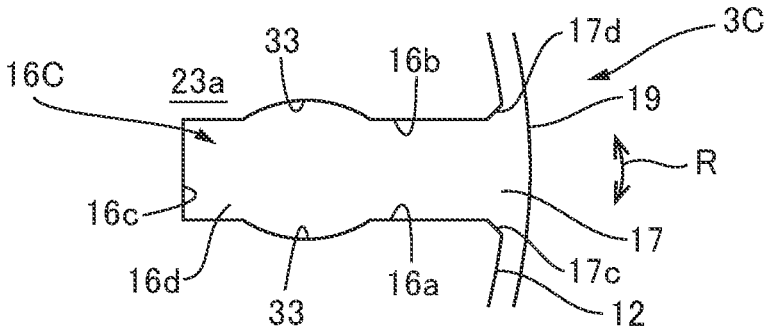

A grinding element bundle holder 3A in a first modification illustrated in FIG. 7A has rectangular recesses 31 recessed in the circumferential direction R at halfway positions in the first inner wall surfaces 16*a* and the second inner wall surfaces 16*b* of a holding hole 16A in the radial direction. A grinding element bundle holder 3 in a second modification illustrated in FIG. 7B has triangular recesses 32 recessed in the circumferential direction R at halfway positions in the first inner wall surfaces 16*a* and the second inner wall surfaces 16*b* of a holding hole 16B in the radial direction. The triangular recesses 32 are formed into wedge shapes. That is to say, the recesses 32 have first recessed wall surfaces 32*a* and second recessed wall surfaces 32*b*, the first recessed wall surfaces 32*a* extend from one inner wall surface that is the first inner wall surface 16*a* or the second inner wall surface 16*b* in the circumferential direction R orthogonal to the radial direction and separated from the other inner wall surface, and the second recessed wall surfaces 32*b* are close to the other inner wall surfaces toward the inner circumferential side from the ends of the first recessed wall surfaces 32*a* in the circumferential direction R. A grinding element bundle holder 3C in a third modification illustrated in FIG. 7C has circular arc recesses 33 recessed in the circumferential direction R at halfway positions in the first inner wall surfaces 16*a* and the second inner wall surfaces 16*b* of a holding hole 16C in the radial direction. The recesses 31, 32, and 33 can be provided in each of the first inner wall surfaces 16*a* and the second inner wall surfaces 16*b* of the holding holes 16A.

Figure 7D:
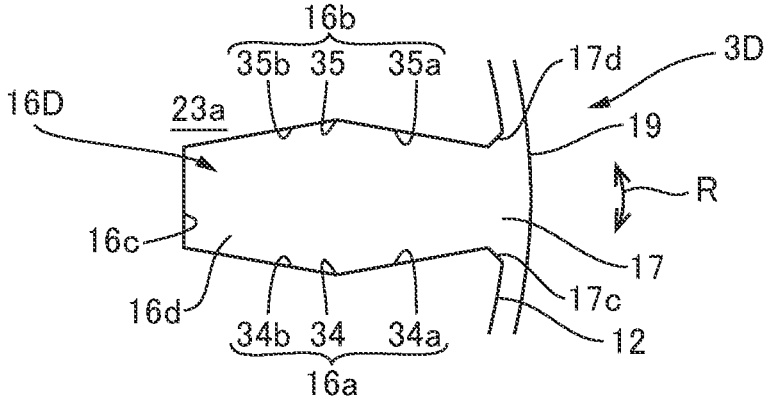
Figure 7E:
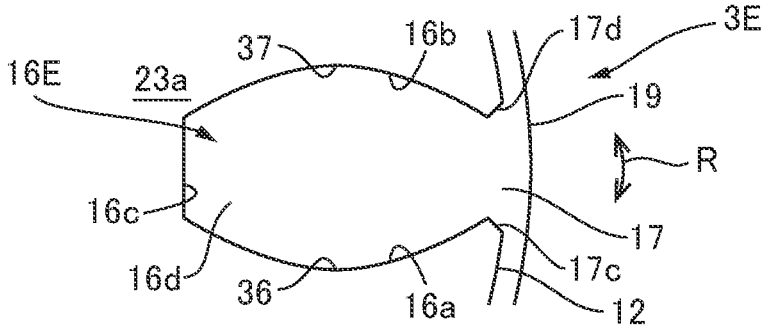

In a grinding element bundle holder 3 in a fourth modification illustrated in FIG. 7D, the first inner wall surface 16*a* has a first inner wall surface portion 34*a* at the outer circumferential side that is inclined toward the inner circumferential side from the grinding element bundle-holding surface 12 in the direction away from the second inner wall surface 16*b* and a first inner wall surface portion 34*b* at the inner circumferential side that is inclined toward the inner circumferential side from the end of the first inner wall surface portion 34*a* at the outer circumferential side at the inner circumferential side in the direction closer to the second inner wall surface 16*b*. The first inner wall surface 16*a* has a recess 34 recessed in the direction away from the second inner wall surface 16*b* at a halfway position in the radial direction as a whole. The second inner wall surface 16*b* has a second inner wall surface portion 35*a* at the outer circumferential side that is inclined toward the inner circumferential side from the grinding element bundle-holding surface 12 in the direction away from the first inner wall surface 16*a* and a second inner wall surface portion 35*b* at the inner circumferential side that is inclined toward the inner circumferential side from the end of the second inner wall surface portion 35*a* at the outer circumferential side at the inner circumferential side in the direction closer to the first inner wall surface 16*a*. The second inner wall surface 16*b* has a recess 35 recessed in the direction away from the first inner wall surface 16*a* at a halfway position in the radial direction as a whole. In a grinding element bundle holder 3E in a fifth modification illustrated in FIG. 7E, the first inner wall surface 16*a* has a circular arc shape recessed in the direction away from the second inner wall surface 16*b*. The first inner wall surface 16*a* has a recess 36 recessed in the direction away from the second inner wall surface 16*b* at a halfway position in the radial direction as a whole. The second inner wall surface 16*b* has a circular arc shape recessed in the direction away from the first inner wall surface 16*a*. The second inner wall surface 16*b* has a recess 37 recessed in the direction away from the first inner wall surface 16*a* at a halfway position in the radial direction as a whole.

In these grinding element bundle holders 3A to 3E, the recesses 31 to 37 provided in at least either of the first inner wall surface 16*a* or the second inner wall surface 16*b* of the holding hole 16 can be filled with the adhesive interposed between the grinding element bundles 4 and the grinding element bundle holder 3. Accordingly, the anchor effect of the adhesive filling the recesses 31 to 37 can prevent or suppress disengagement of the grinding element bundles 4 inserted into the holding holes 16.

The third inner wall surfaces 16*c* of the holding holes 16 may be curved toward the outer circumferential side or may be bent. FIG. 8 is a descriptive view for explaining the grinding element bundle holder 3 in modifications in which the shape of the third inner wall surface 16*c* dividing each holding hole 16 is changed. In FIG. 8, the opening portion of each holding hole 16 that is exposed to the lamination surface 23*a* of the first holder member 23 is seen from the axial line L direction.

Figure 8A:
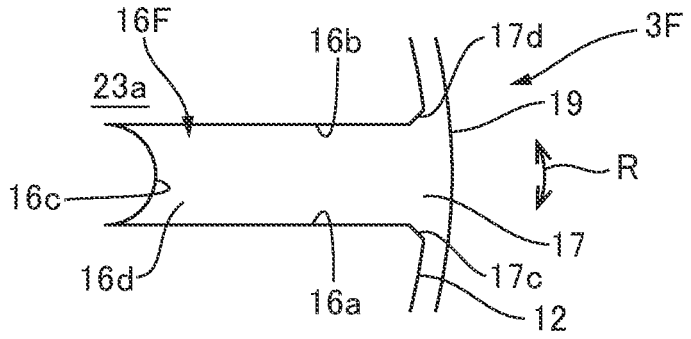
FIG. 8 is a descriptive view for explaining grinding element bundle holders in modifications in which a shape of an inner wall surface of each holding hole is changed.
Figure 8B:
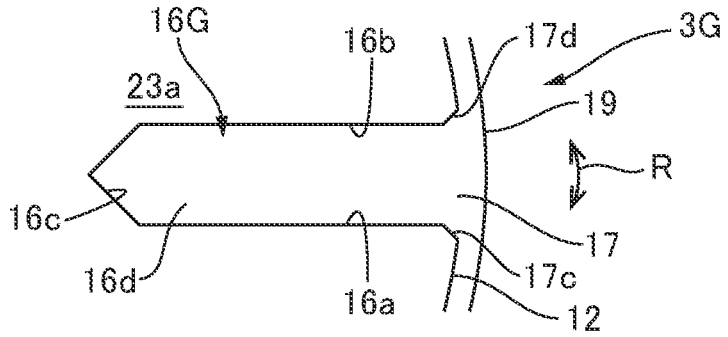
Figure 8C:
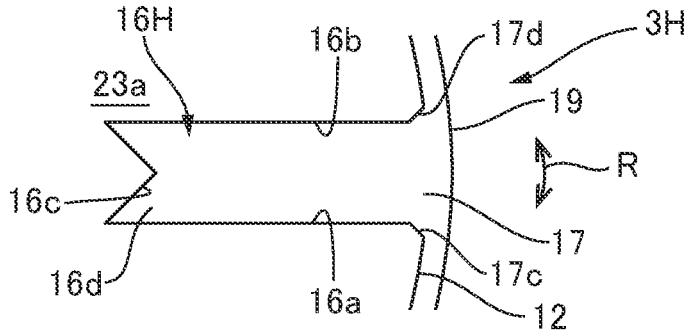

In a grinding element bundle holder 3F in a sixth modification illustrated in FIG. 8A, a center portion of the third inner wall surface 16*c* of a holding hole 16F in the circumferential direction R is curved to form a shape protruding to the outer circumferential side. In a grinding element bundle holder 3G in a seventh modification illustrated in FIG. 8B, the third inner wall surface 16*c* of a holding hole 16G is bent at the center in the circumferential direction R and a center portion thereof in the circumferential direction R is recessed to the inner circumferential side. In a grinding element bundle holder 3H in an eighth modification illustrated in FIG. 8C, the third inner wall surface 16*c* of a holding hole 16H is bent at the center in the circumferential direction R and a center portion thereof in the circumferential direction R protrudes to the outer circumferential side. Even in these grinding element bundle holders 3F to 4H, the adhesion area between the third inner wall surface 16*c* and the grinding element bundle 4 can be increased. Accordingly, disengagement of the grinding element bundles 4 inserted into the holding holes 16 can be prevented or suppressed.

The invention claimed is:

1. A wheel brush comprising: a grinding element bundle holder which has a grinding element bundle-holding surface facing an outer circumferential side of the grinding element bundle holder while surrounding a rotational center line thereof; the grinding element bundle-holding surface having holding holes arrayed in a circumferential direction of the grinding element bundle holder; and a plurality of grinding element bundles, wherein each of the plurality of grinding element bundles has an end portion and comprises wire-shaped grinding elements gathered in parallel, the end portion of each of the plurality of grinding element bundles is inserted into one of the holding holes so that the end portion of each of the plurality of grinding element bundles is held at an inner circumferential side of the holder so that the grinding element bundles protrude to the outer circumferential side from the grinding element bundle-holding surface and are radially arrayed about the rotational center line, each of the wire-shaped grinding elements has a flattened-shape in a grinding element cross section, taken along a direction orthogonal to an element axial direction, the flattened shape being such a shape that a distance from the center of the grinding element cross section to an outer periphery thereof is not constant and a length of the grinding element cross section in a lengthwise direction and that in a short-side direction are different from each other; wherein the holder has first protrusions protruding to the outer circumferential side, each of which is provided adjacent to a first opening edge of each of the holding holes at one side in a rotational center line direction, second protrusions protruding to the outer circumferential side, each of which is provided on a second opening edge of each of the holding holes at the other side in the rotational center line direction, each of the first protrusions is continuous to the first protrusions adjacent thereto in the circumferential direction to configure a first flange portion, each of the second protrusions is continuous to the second protrusions adjacent thereto in the circumferential direction to configure a second flange portion, wherein each of the holding holes further have two circumferential direction opening edge portions formed on the outer circumferential side of the grinding element bundle-holding surface located adjacent to each of the first and second opening edges of the holding holes in the circumferential direction, wherein the two circumferential direction opening edge portions are curved and inclined toward the inner circumferential side of each of the holding holes, and in 75% or more of the wire-shaped grinding elements which form each of the grinding element bundles, the short-side of the flattened-shape in the grinding element cross section of each of the wire-shaped grinding elements is directed to the circumferential direction.

2. The wheel brush according to claim 1, wherein a shape of an opening of each of the holding holes in the grinding element bundle-holding surface is a rectangle whose width in the circumferential direction is smaller than a height in the rotational center line direction, and each of the grinding element bundles is a rectangle in cross sectional view taken along the grinding element bundle-holding surface so that each of the grinding element bundles is fitted with the opening of each of the holding holes in the grinding element bundle-holding surface.

3. The wheel brush according to claim 1, wherein an adhesive, which is interposed between the grinding element bundle holder and the grinding element bundles in the holding holes so as to fix the grinding element bundles to the grinding element bundle holder is provided, each of the holding holes has a first inner wall surface and a second inner wall surface opposing each other in the circumferential direction and a third inner wall surface connecting an end of the first inner wall surface at the inner circumferential side and an end of the second inner wall surface at the inner circumferential side, and an interval between the first inner wall surface of each of the holding holes and the second inner wail surface thereof is enlarged toward the third inner wall surface from the grinding element bundle-holding surface.

4. The wheel brush according to claim 1, wherein an adhesive, which is interposed between the grinding element bundle holder and the grinding element bundles in the holding holes so as to fix the grinding element bundles to the grinding element bundle holder is provided, each of the holding holes has a first inner wall surface and a second inner wall surface opposing each other in the circumferential direction and a third inner wall surface connecting an end of the first inner wail surface at the inner circumferential side and an end of the second inner wall surface at the inner circumferential side, and one of the first inner wall surface and the second inner wall surface has a recess recessed in a direction away from the other.

5. The wheel brush according to claim 1, wherein an adhesive, which is interposed between the grinding element bundle holder and the grinding element bundles in the holding holes so as to fix the grinding element bundles to the grinding element bundle holder is provided, each of the holding holes has a first inner wail surface and a second inner wall surface opposing each other in the circumferential direction and a third inner wall surface connecting an end of the first inner wall surface at the inner circumferential side and an end of the second inner wall surface at the inner circumferential side, and a center portion of the third inner wall surface is folded or bent toward the inner circumferential side of each of the holding holes.

* * * * *